US006881282B2

(12) United States Patent
Dupuis et al.

(10) Patent No.: US 6,881,282 B2
(45) Date of Patent: Apr. 19, 2005

(54) METHOD OF MANUFACTURING A CHROMED BUMPER

(75) Inventors: Lawrence Dupuis, Grosse Ile, MI (US); Kevin W. Kiedaisch, Brownstown, MI (US); Mark Bala, Deerfield, IL (US); Dennis Urban, Orland Park, IL (US)

(73) Assignees: Ford Motor Company, Dearborn, MI (US); Ispat Inland, Inc., East Chicago, IN (US)

( * ) Notice: Subject to any disclaimer, the term of this patent is extended or adjusted under 35 U.S.C. 154(b) by 0 days.

(21) Appl. No.: 09/683,914

(22) Filed: Mar. 1, 2002

(65) Prior Publication Data

US 2004/0149358 A1 Aug. 5, 2004

Related U.S. Application Data

(60) Provisional application No. 60/272,913, filed on Mar. 2, 2001.

(51) Int. Cl.[7] ..... B21D 53/88

(52) U.S. Cl. ..... 148/525; 148/530; 29/897.2; 29/527.4; 427/178; 427/328

(58) Field of Search ..... 148/525, 530, 148/534; 29/897.2, 527.4

(56) References Cited

U.S. PATENT DOCUMENTS 5,376,464 A * 12/1994 Dupoiron et al. ..... 428/679
5,438,179 A * 8/1995 Boppel et al. ..... 219/121.19
5,459,297 A * 10/1995 Boppel et al. ..... 219/121.25
6,325,430 B1 * 12/2001 King ..... 293/102

FOREIGN PATENT DOCUMENTS

JP 02-274866 A * 11/1990

* cited by examiner

*Primary Examiner*—George Wyszomierski
(74) *Attorney, Agent, or Firm*—Gigette M. Bejin; Baker and Daniels

(57) ABSTRACT

The present invention is a method for preparing and chroming a blank of steel. This method reduces time and cost to the assembly process. The method includes the following steps: heating steel slabs to a pre-determined temperature, hot rolling the steel slabs to a pre-determined width/thickness; spraying the steel strips with water to remove scaling; pickling the steel strips in acid to remove scaling; rinsing and drying the strips; cold rolling the strips with an electron beam textured tandem mill into strips having a pre-determined thickness; cold rolling the strips with an electron beam temper mill; and stamping the steel strips into a bumper.

15 Claims, 2 Drawing Sheets

METHOD OF MANUFACTURING A CHROMED BUMPER

CROSS REFERENCE TO RELATED APPLICATIONS

This application claims the benefit of U.S. Provisional Application Ser. No. 60/272,913 filed Mar. 2, 2001.

BACKGROUND OF INVENTION

1. Field of the Invention

The present invention generally relates to the field of manufacturing and more specifically, to the manufacture of chromed vehicle bumpers.

2. Background of the Invention

A vehicle bumper is a component attached to the front and rear ends of a vehicle to serve as an energy dissipation device in a collision, thereby protecting the vehicle body and the driver.

Vehicle bumpers are generally formed of steel which must undergo several processes prior to chroming. By way of background, steel must be initially processed through a hot strip mill. Steel slabs are heated to approximately 2275 degrees Fahrenheit and are delivered from the furnaces to an 80 inch hot strip rolling mill so that the strips are rolled to a nominal thickness of 9¼ inches. The slabs are discharged from the furnace with a nominal thickness of 9¼ inches and delivered to vertical scale breaker within seconds. The vertical scale breaker reduces the bar to the desired width and helps break up the oxide layer formed on the slab surfaces during reheating. The bar is then sprayed with high pressure (approximately 1850 psi) descale spray water to mechanically clean the bar and force any freshly formed scale off of the bar.

A harder oxide layer also called scale forms on the outside of the strip during the final stages of the hot rolling process. The scale adversely affects the quality of any finish coating applied to the steel. Typically, either sulphuric or hydrochloric acid may be used on a pickle line. The strip may be immersed in a number of acid baths to remove the oxide scale. The acid bath may be combined with an electric current (electrolytic pickling) to remove the oxide scale. After immersion in the acid baths, the strip is generally rinsed in water and dried in warm air before being coiled again.

Referring now to FIG. 1, a flowchart demonstrating the steps of manufacturing a chromed bumper from steel strips is illustrated. The strip undergoes the cold rolling operation 52 which involves passing the material through narrow rolls. The cold rolling process generally requires several passes back and forth over the strip by a Tandem Mill and a Temper Mill such that the steel gradually becomes harder and is said to be cold hardened. The strip is cold rolled through a temper mill and a tandem mill to reduce the width/thickness of the steel strips and then the strip is slit and sheared 54 into blanks. The blanks are generally polished 56 using a sand paper belt and then cleaned 58 and inspected to determine whether an adequate surface finish was attained. A drawback of using a sand paper belt is that this polishing method leaves linear scratch marks on the steel thereby reducing the quality of the surface finish.

Once the blanks are polished with the sand paper belt, the blanks are coated 60 with Zinc Phosphate and a dry film lube to prepare the blank for stamping. After forming or stamping 62 the bumpers, the bumpers are cleaned and buffed 64 to ensure that film from the zinc phosphate and dry film lube is removed and treated 65 to remove the zinc phosphate and dry film lube. The bumper surface is then electroplated 66 with nickel and then chromed.

The prior art process to manufacture a vehicle bumper is not only time-consuming and expensive due to the cleaning and polishing requirements, but also the polishing process does not provide a homogenous surface for chroming, nor is the surface texture repeatable, ordered and deterministic.

Consequently a need has developed for an efficient means of manufacturing bumpers which reduces cost and manufacture time while improving the surface finish of the bumper for the chroming process.

SUMMARY OF INVENTION

It is a principle object of the present invention to provide a method for manufacturing a chromed bumper which does not require a separate process to treat/texturize the surface of the steel.

It is yet another object of the present invention to provide a method for manufacturing a chromed bumper at a reduced cost.

It is still another object of the present invention to provide a method for manufacturing chromed bumper which reduces manufacture time.

It is yet another object of the present invention to provide a method for manufacturing a chromed bumper where the surface finish of the bumper is improved over the surface finish of the prior art techniques.

In accordance with the above objects and other objects and features of the present invention, a method for manufacturing chromed bumpers is provided where the method includes: heating steel slabs to a pre-determined temperature, hot rolling the steel slabs to a pre-determined width/thickness; spraying the steel strips with water to remove scaling; pickling the steel strips in acid to remove scaling; rinsing and drying the strips; cold rolling the strips with an electron beam textured tandem mill into strips having a pre-determined thickness; cold rolling the strips with an electron beam temper mill; and stamping the steel strips into a bumper.

The above objects and other objects, features, and advantages of the present invention are more readily understood from a review of the attached drawings and accompanying specification.

DETAILED DESCRIPTION

The present invention provides a method for manufacturing chromed bumpers. Bumpers require a particular surface finish before the bumpers may undergo the chroming process.

Figure 1:
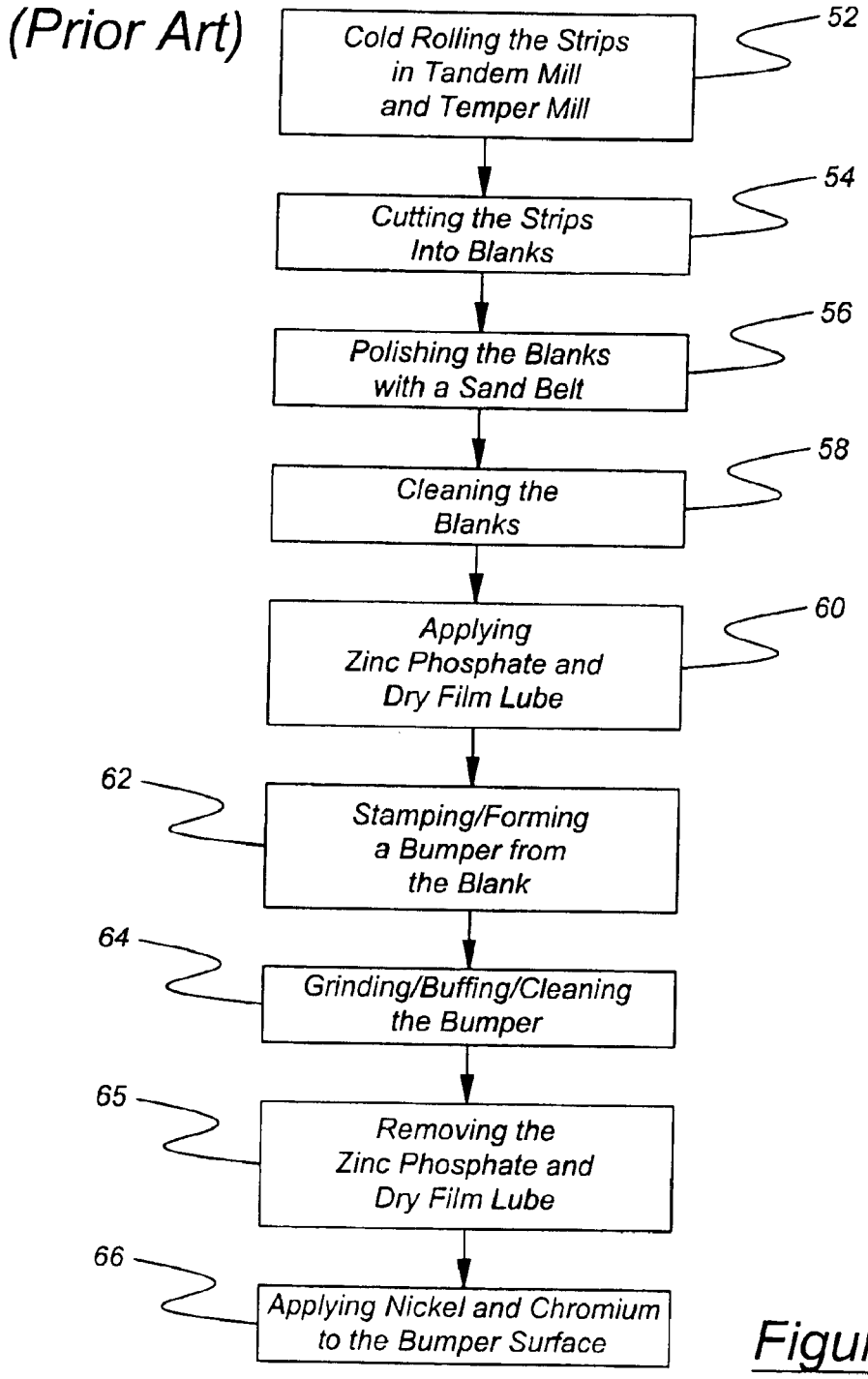
FIG. 1 is a flow chart which illustrates the prior art method for manufacturing chrome bumpers.
Figure 2:
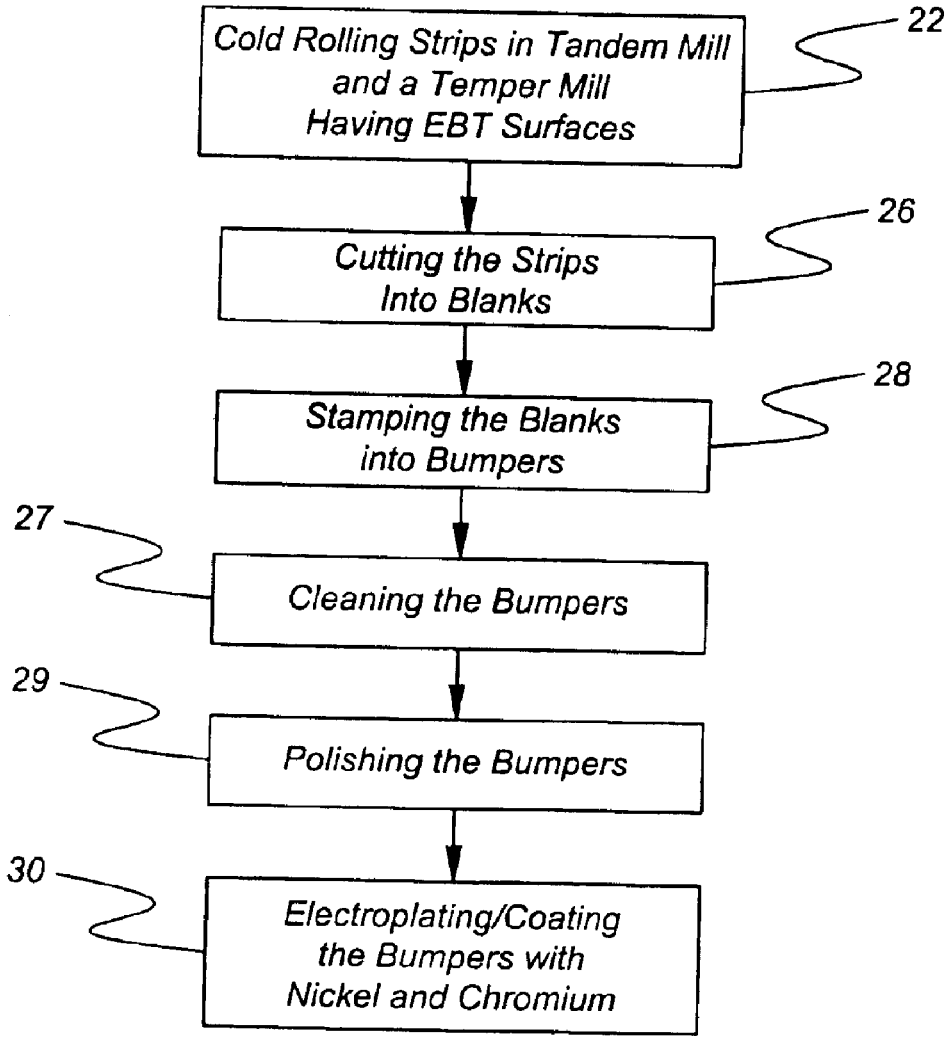
FIG. 2 is a flow chart which illustrates a first embodiment of the method steps of the present invention.

With reference to FIG. 2, the method 10 for manufacturing chromed bumpers is illustrated in a flow chart diagram. Steel strips are manufactured by heating a steel strip to a predetermined temperature. The pre-determined temperature may but not necessarily be 2275 degrees Fahrenheit. Once the steel strip is heated, the strip is rolled to attain a pre-determined thickness. The steel strip is then sprayed with water and then immersed or pickled in either sulphuric, hydrochloric acid or the like to remove any scaling or residue that developed on the steel. The strip should preferably be cleaned and dried after it undergoes the pickling process.

According to the method of the present invention, the steel strips are cold rolled 22 in a tandem mill and a temper mill. The tandem mill preferably but not necessarily may be a four-high four stand cold reduction mill with a rolling solution system consisting of three 20,000 gallon roll solution supply tanks, filters, and three supply pumps. The tandem mill preferably has an electron beam textured surface which imparts a homogeneous and uniform patterned surface onto the strip. The tandem mill rolls may be textured using an electron beam. The texture may, but not necessarily, be one of the patterns offered by the Sidstahl Corporation. Sidstahl's publication regarding its Sibetex technology is incorporated by reference herein. The tandem mill specifications may, but not necessarily, be as follows:

| | RPM | Horsepower | Max. Speed (21.5" rolls) |
|---|---|---|---|
| Stand 1 | 100/335 | 3,000 | 1,755 fpm |
| Stand 2 | 150/470 | 5,000 | 2,490 fpm |
| Stand 3 | 250/700 | 6,000 | 3,755 fpm |
| Stand 4 | 250/700 | 6,000 | 3,848 fpm |

The tandem mill operates to reduce the thickness of the steel strips. Similar to the tandem mill, the temper mill should preferably have an electron beam textured finish which imparts a uniform and homogeneous crater-like finish to the steel strip or blank. The temper mill may be a single stand, four-high mill. Strip surface roughness may, but not necessarily, be from 0.7 to 1.2 micrometers with a nominal roughness of 0.9 micrometers.

Once the strip has been rolled 22 with the electron beam textured tandem mill and temper mill, the strip may be cut 26 into blanks and then may immediately formed or stamped 28 into a bumper construction. The strip is then cleaned 27 and polished 29 to remove any residue. Finally, the stamped bumper may be electroplated 30 with nickel and then chromed.

By texturing the blank with both the temper mill and the tandem mill, the step of flat polishing the steel with a sand belt (right after it is cold rolled) is eliminated thereby reducing manufacture time. By eliminating the step of flat polishing with sanding belts, linear scratches no longer occur and accordingly, this results in an improved surface finish for the chroming process wherein the manufacturing time is also reduced.

Moreover, the surface finish of the blank under the method of the present invention does not require zinc phosphate and dry film lube to prepare the blank for the stamping process. Accordingly, the cleaning time for each blank is reduced.

Having described the method of the present invention, various advantages and uses will become apparent to those skilled in the art. Further, upon reading the foregoing description, it will be readily appreciated by those skilled in the art that modification may be made to the invention without departing from the concepts disclosed herein. Such modifications are considered as included in the following claims unless these claims by their language expressly state otherwise.

What is claimed is:

1. A method for preparing steel for chroming, the method comprising the steps of:

providing a steel strip having a first predetermined thickness;

cold rolling the strip into a blank using an electron beam textured roller to a second predetermined thickness; and coating the blank with Nickel and then Chromium.

2. The method for preparing steel for chroming as defined in claim 1 wherein the step of cold rolling results in a strip surface finish of approximately 0.7 to 1.2 micrometers with a nominal roughness of 0.9 micrometers.

3. The method for preparing steel for chroming as defined in claim 1 wherein the the step of cold rolling is performed by a tandem mill and a temper mill.

4. The method for preparing steel for chroming as defined in claim 3 wherein the tandem mill is a four-high four stand cold reduction mill.

5. The method for preparing steel for chroming as defined in claim 4 wherein the tandem mill and the temper mill include rolls texturized with an electron beam.

6. A method for preparing steel for chroming, the method comprising the steps of:

heating a strip of steel;

rolling the strip to a first predetermined thickness;

spraying the strip of steel with water;

immersing the strip in a descaling compound;

cleaning the strip; drying the strip;

cold rolling the strip into a blank using an electron beam textured roller to a second predetermined thickness; and coating the blank with Nickel and Chromium.

7. The method for preparing steel for chroming defined in claim 6, wherein a tandem mill performs the step of rolling the strip to the first predetermined thickness.

8. The method for preparing steel for chroming as defined in claim 6, wherein the strips are heated to a temperature of approximately 2275 degrees Fahrenheit.

9. The method for preparing steel for chroming as defined in claim 6, wherein the strips are rolled to a nominal thickness of about 9.25 inches.

10. The method for preparing steel for chroming as defined in claim 6 wherein the step of immersing the strip includes immersing the strip in one of a sulphuric acid or a hydrochloric acid.

11. The method for preparing steel for chroming as defined in claim 6 wherein the step of cold rolling results in a strip surface finish of approximately 0.7 to 1.2 micrometers with a nominal roughness of 0.9 micrometers.

12. The method for preparing steel for chroming as defined in claim 6 wherein the step of cold rolling the strip into a blank is performed first by a tandem mill and second by a temper mill.

13. The method for preparing steel for chroming as defined in claim 12 wherein the tandem mill is a four-high four stand cold reduction mill.

14. The method for preparing steel for chroming as defined in claim 12 wherein the tandem mill includes the electron beam textured roller.

15. A method of forming a chromed steel bumper comprising the steps of:

heating a strip of steel;

rolling the strip to a first predetermined thickness using an electron beam textured roller;

spraying the strip with water;

immersing the strip in a descaling compound;

cleaning the strip;

drying the strip;

cold rolling the strip using an electron beam textured roller to a second predetermined thickness;

annealing the strip;

forming the strip into a bumper;

coating the bumper with Nickel and Chromium.

* * * * *